US006880709B2

(12) United States Patent
Chen

(10) Patent No.: US 6,880,709 B2
(45) Date of Patent: Apr. 19, 2005

(54) FOOT STRUCTURE OF A RACK FOR HOLDING SPRAY NOZZLES

(75) Inventor: Chin-Yuan Chen, Chang-Hua Hsien (TW)

(73) Assignee: Shin Tai Spurt Water of the Garden Tools, Co., Ltd., Changhua Hsien (TW)

( * ) Notice: Subject to any disclaimer, the term of this patent is extended or adjusted under 35 U.S.C. 154(b) by 0 days.

(21) Appl. No.: 10/326,314

(22) Filed: Dec. 23, 2002

(65) Prior Publication Data

US 2004/0118796 A1 Jun. 24, 2004

(51) Int. Cl.[7] ..... A47F 7/00
(52) U.S. Cl. ..... 211/70.6; 211/60.1
(58) Field of Search ..... 211/70.6, 60.1, 211/182, 189, 105.1, 134, 183; 280/71.3; 16/32, 42 T, 43; 248/188.8, 188.1–188.5, 188.9, 512, 519, 529, 518, 511, 75, 80, 83, 89; 403/263, 300, 326, 341, 345, 375, 297, 302, 301, 380, 202, 315, 316; D6/469, 491, 495; 297/463.1; 312/351.11

(56) References Cited

U.S. PATENT DOCUMENTS

| | | | | | |
|---|---|---|---|---|---|
| 2,631,330 | A | * | 3/1953 | Becker | 16/30 |
| 4,243,194 | A | * | 1/1981 | Moore et al. | 248/188.1 |
| 4,731,900 | A | * | 3/1988 | Frobose | 16/38 |
| 4,807,838 | A | * | 2/1989 | Anderson | 248/188.1 |
| 4,898,493 | A | * | 2/1990 | Blankenburg | 403/326 |
| 4,923,158 | A | * | 5/1990 | Saisho | 248/188.8 |
| 5,017,068 | A | * | 5/1991 | Cooksey | 411/373 |
| 5,088,669 | A | * | 2/1992 | Zinnbauer | 248/188.9 |
| 5,125,646 | A | * | 6/1992 | Wilkinson | 482/52 |
| 5,153,052 | A | * | 10/1992 | Tanaka et al. | 428/212 |
| 5,556,181 | A | * | 9/1996 | Bertrand | 312/313 |
| 5,628,400 | A | * | 5/1997 | Feder | 206/379 |
| 6,012,868 | A | * | 1/2000 | Aoki | 403/326 |
| 6,032,589 | A | * | 3/2000 | Wang | 108/147.11 |
| 6,230,985 | B1 | * | 5/2001 | Wang | 239/273 |
| 6,292,979 | B1 | * | 9/2001 | Kuo | 16/113.1 |
| D453,884 | S | * | 2/2002 | Wang | D6/469 |
| D454,012 | S | * | 3/2002 | Chen | D6/469 |
| D454,013 | S | * | 3/2002 | Wang | D6/469 |
| 6,354,231 | B1 | * | 3/2002 | Morris | 108/144.11 |
| D458,774 | S | * | 6/2002 | Chao | D6/469 |
| 6,398,045 | B1 | * | 6/2002 | Chao | 211/181.1 |
| D461,085 | S | * | 8/2002 | Chen | D6/552 |
| 6,439,519 | B1 | * | 8/2002 | Takamasa | 248/188.8 |
| 6,471,076 | B1 | * | 10/2002 | Chen | 211/70.6 |
| 6,508,369 | B1 | * | 1/2003 | Wang | 211/60.1 |
| 6,588,717 | B1 | * | 7/2003 | Carnahan et al. | 248/188.8 |
| 6,623,082 | B1 | * | 9/2003 | Huang | 297/463.1 |

* cited by examiner

*Primary Examiner*—Jennifer E. Novosad
(74) *Attorney, Agent, or Firm*—Alan D. Kamrath; Nikolai & Mersereau, P.A.

(57) ABSTRACT

A rack for holding spray nozzles is formed of a top frame and a bottom frame. The top frame is provided with a plurality of legs which are provided in proximity of a bottom end with a plurality of retaining slots. The legs are fitted into the hollow support rods of the bottom frame. The hollow support rods are provided in a bottom end with a foot fitted thereinto. The foot is provided with a plurality of retaining projections, which are retained in the retaining slots of the bottom end of one of the legs of the top frame. The bottom end of the hollow support rods of the bottom frame is sealed off by the foot. The foot also serves to provide the bottom end of the hollow support rods with a frictional contact with a surface.

2 Claims, 5 Drawing Sheets

FOOT STRUCTURE OF A RACK FOR HOLDING SPRAY NOZZLES

RELATED U.S. APPLICATIONS

Not applicable.

STATEMENT REGARDING FEDERALLY SPONSORED RESEARCH OR DEVELOPMENT

Not applicable.

REFERENCE TO MICROFICHE APPENDIX

Not applicable.

FIELD OF THE INVENTION

The present invention relates generally to a rack for holding spray nozzles, and more particularly to a foot structure on which the rack stands on a surface.

BACKGROUND OF THE INVENTION

As shown in FIGS. 4 and 5, a prior art rack comprises a top frame 40 and a bottom frame 41. The top frame 40 is provided with a retaining projection 43. The bottom frame 41 is provided with four legs, each receiving a fitting portion 42 of the top frame 40 which is provided with four support rods 44, each having a receiving hole 45 which is provided with an arresting edge 46. The top frame 40 is joined with the bottom frame 41 such that the four fitting portions 42 of the top frame 40 are fitted into the four receiving holes 45 of the bottom frame 41. The fitting portions 42 are located securely in the receiving holes 45 by the retaining projection 43 which is arrested by the arresting edge 46 of the receiving hole 45. The four support rods 44 of the bottom frame 41 are of a hollow construction and are rested on a surface.

The prior art rack described above is defective in design in that it is integrally made of a plastic material by injection molding and is therefore apt to slide easily by itself. In addition, the hollow support rods 44 of the bottom frame 41 are likely to be infested with the household pests.

BRIEF SUMMARY OF THE INVENTION

The primary objective of the present invention is to provide a rack which is used for holding spray nozzles and is free of the shortcomings of the prior art rack described above.

In keeping with the principle of the present invention, the foregoing objective of the present invention is attained by a rack comprising a top frame and a bottom frame. The top frame is provided with a plurality of legs, each having two retaining slots opposite to each other. The bottom frame is provided with a plurality of hollow support rods corresponding in location to the legs of the top frame, and a plurality of feet, each having two retaining projections opposite to each other. Each leg of the top frame is fitted into a top end of one of the support rods of the bottom frame, while each foot is fitted into a bottom end of one of the support rods of the bottom frame such that the two retaining projections of the foot are retained securely in the two retaining slots of the leg, and that the bottom end of the support rod is sealed off by the foot. The feet of the present invention are made of a skidproof material. Furthermore, the feet of present invention may be optionally provided with a wheel pivoted therewith.

The features and the advantages of the present invention will be more readily understood upon a thoughtful deliberation of the following detailed description of two preferred embodiments of the present invention with reference to the accompanying drawings.

DETAILED DESCRIPTION OF THE INVENTION

Figure 1:
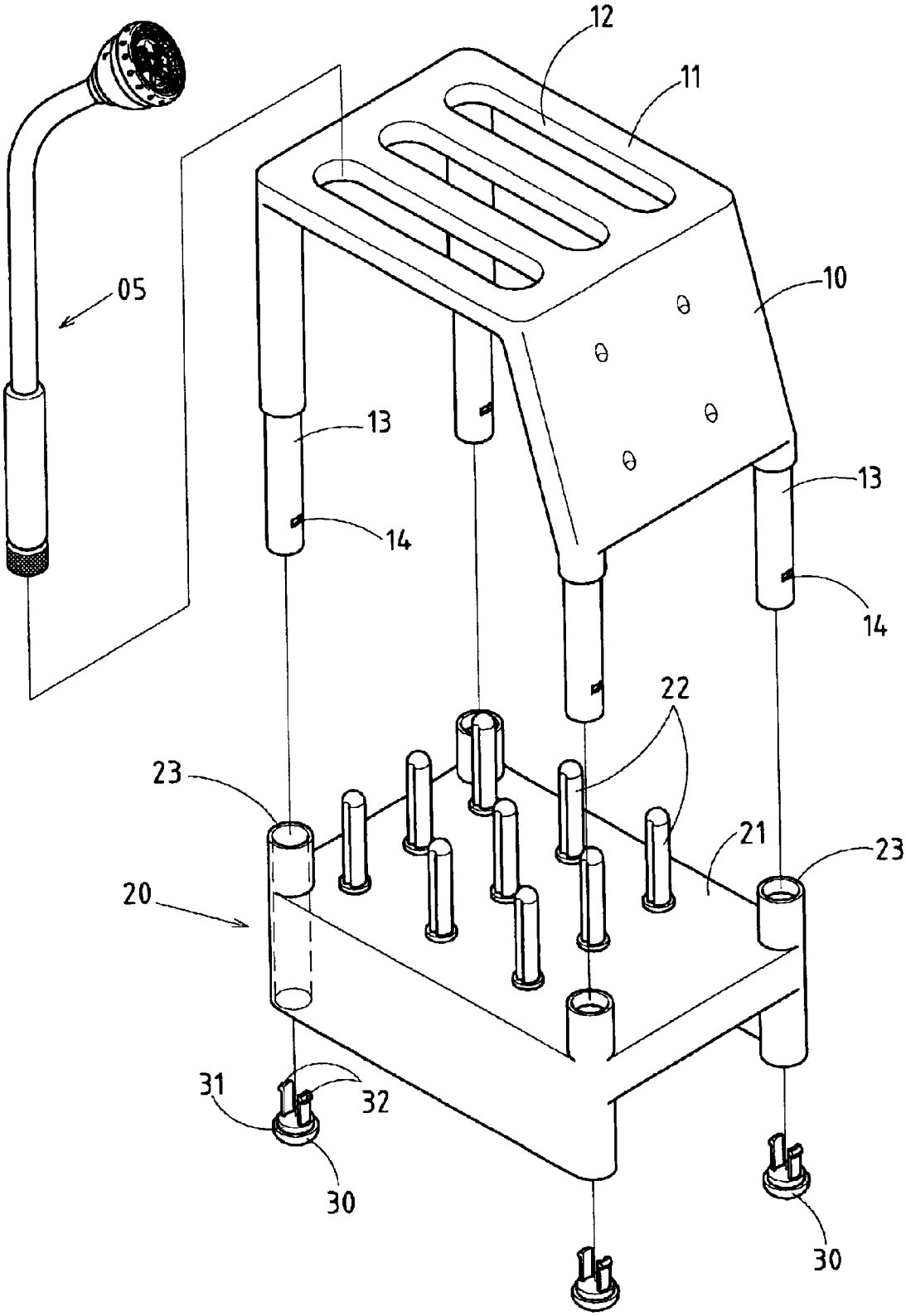
FIG. 1 shows an exploded perspective view of a first preferred embodiment of the present invention.
Figure 2:
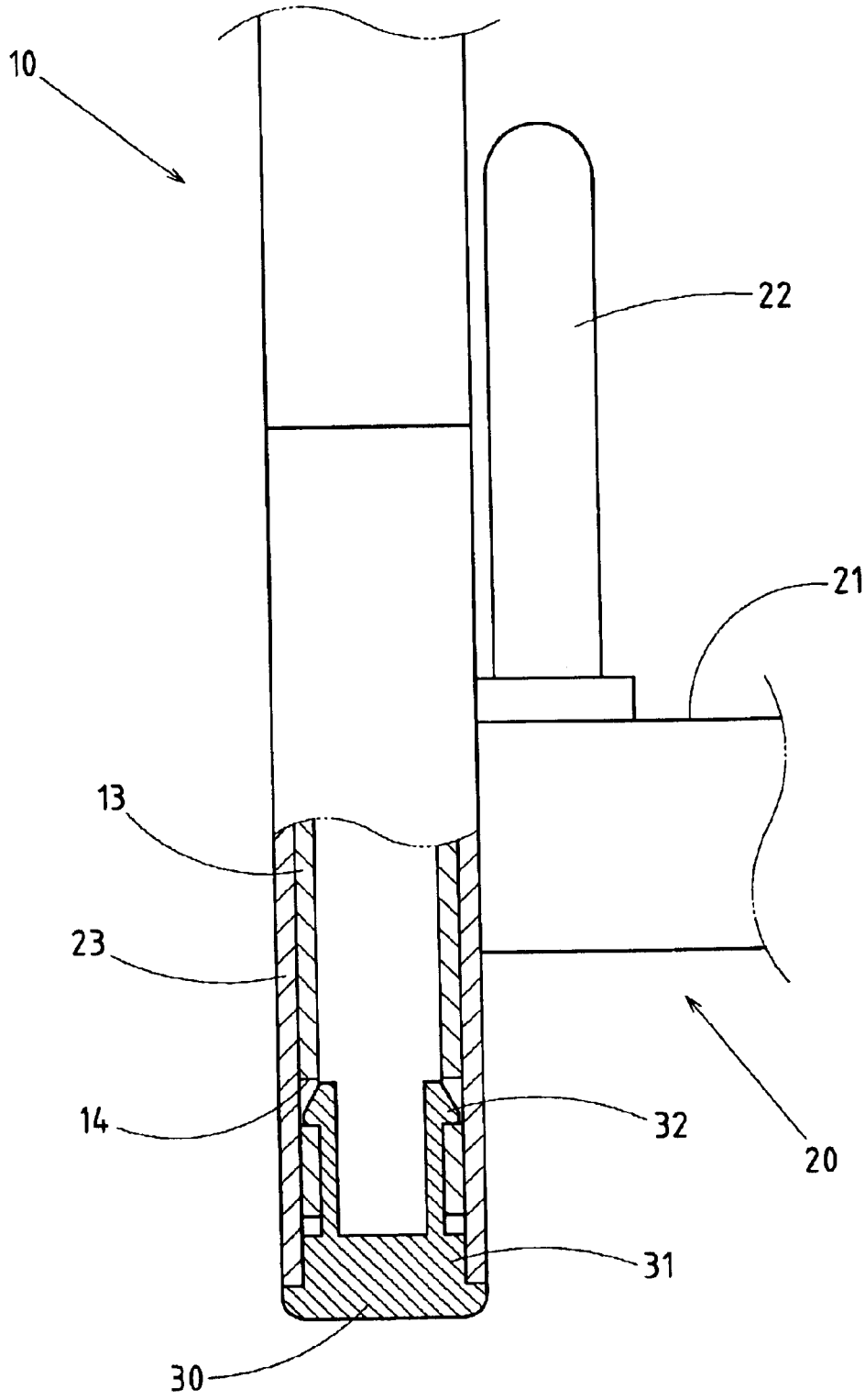
FIG. 2 shows a partial longitudinal sectional view of the first preferred embodiment of the present invention.

As shown in FIGS. 1 and 2, a rack embodied in the present invention is used to hold a plurality of spray nozzles 05 and is formed of a top frame 10 and a bottom frame 20.

The top frame 10 is formed of a plate 11 and four legs 13. The plate 11 is provided with a plurality of through slots 12. The legs 13 are provided in proximity of a bottom end with two retaining slots 14 opposite to each other.

The bottom frame 20 is provided with plate 21, four support rods 53 and four feet 30. The plate 21 is provided in the upper side with a plurality of upright pillars 22 corresponding in location to the through slots 12 of the top frame 10. The upright pillars 22 are used to locate the barrels of the spray nozzles 05 through the through slots 12 of the top frame 10. The support rods 23 are of a hollow construction and are corresponding in location to the legs 13 of the top frame 10. The top frame 10 is joined with the bottom frame 20 such that the legs 13 of the top frame 10 are fitted into the hollow support rods 23 of the bottom frame 20, as shown in FIG. 2. The feet 30 are provided in an upper side with a fitting portion 31 which is in turn provided with two retaining projections 32. The fitting portion 31 is dimensioned to fit into the bottom end of the support rods 23. Each foot 30 is joined with the bottom end of one of the four support rods 23 such that the fitting portion 31 is fitted into the bottom end of the support rod 23, and that the two retaining projections 32 of the foot 30 are retained in the two retaining slots 14 of the leg 13 which is inserted into the top end of the support rod 23. The bottom end of the support rod 23 is sealed off by the foot 30, thereby preventing the support rod 23 from being infested with the household pests. The feet 30 also serve to help the support rods 23 stand firmly on a surface. In order to enhance the frictional contact of the feet 30 with the surface so as to avert the sliding of the feet 30 on the surface by themselves, the feet 30 are made of a skidproof material.

Figure 3:
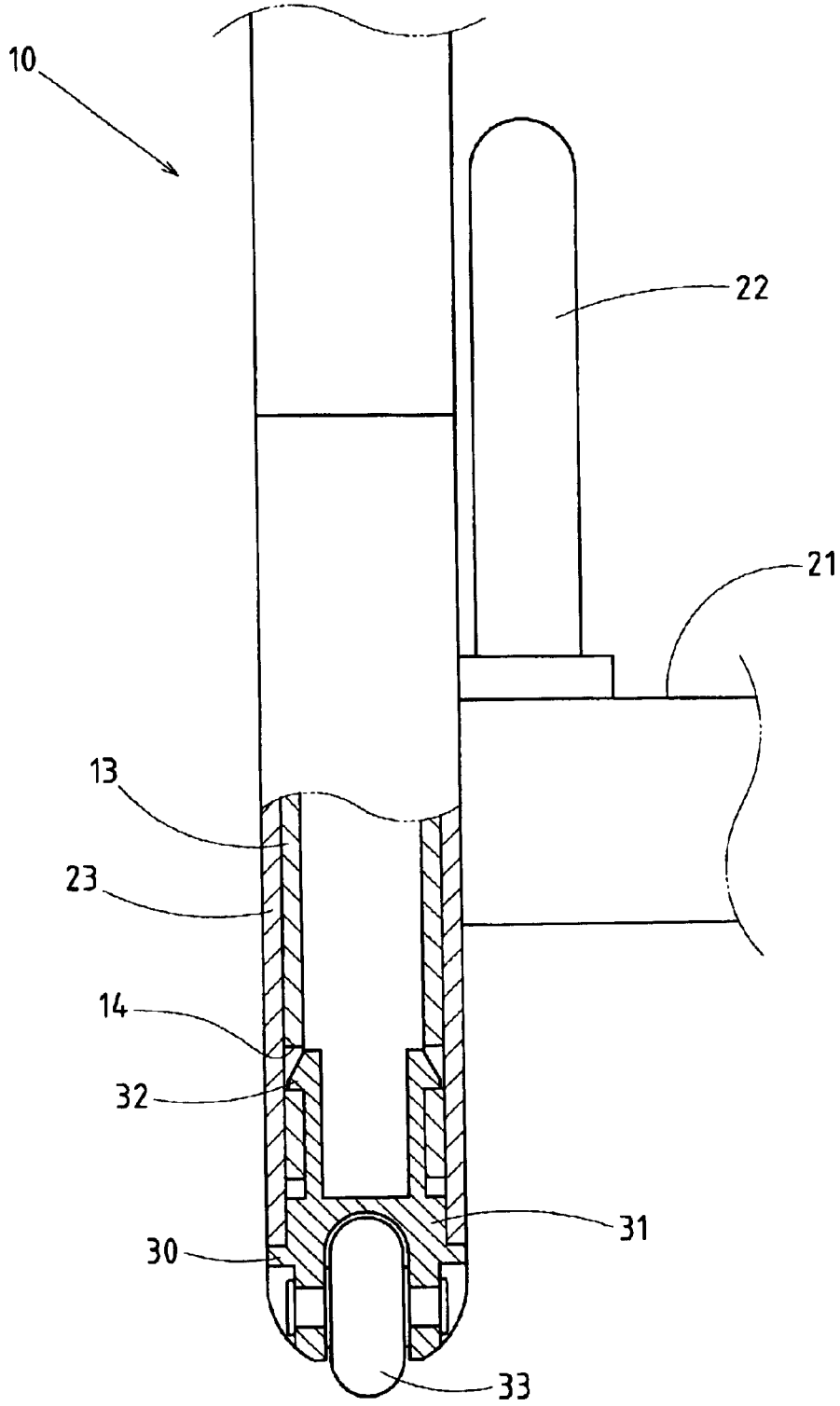
FIG. 3 shows a partial longitudinal sectional view of a second preferred embodiment of the present invention.
Figure 4:
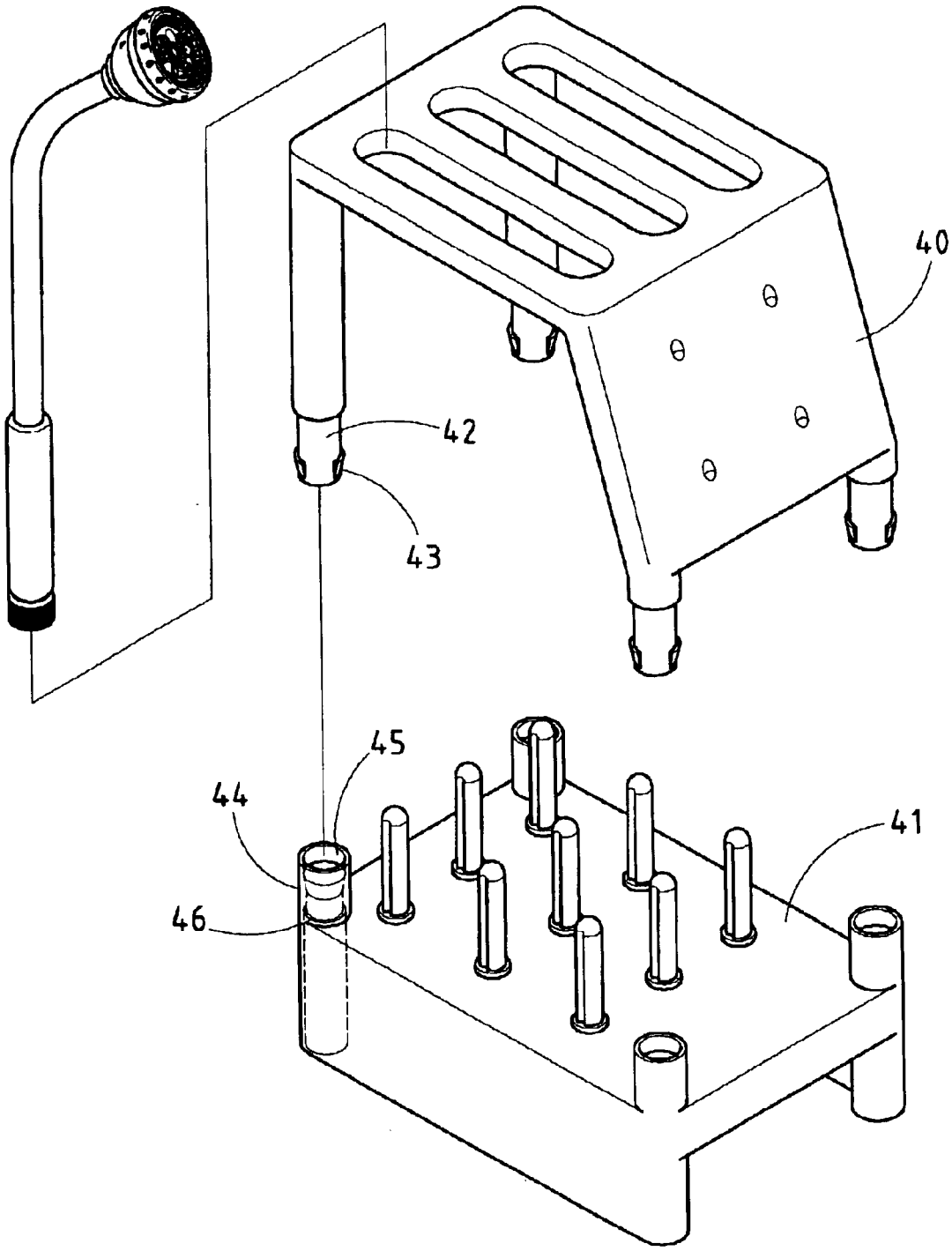
FIG.4 PRIOR ART
FIG. 4 shows an exploded perspective view of a prior art rack for holding spray nozzles.
Figure 5:
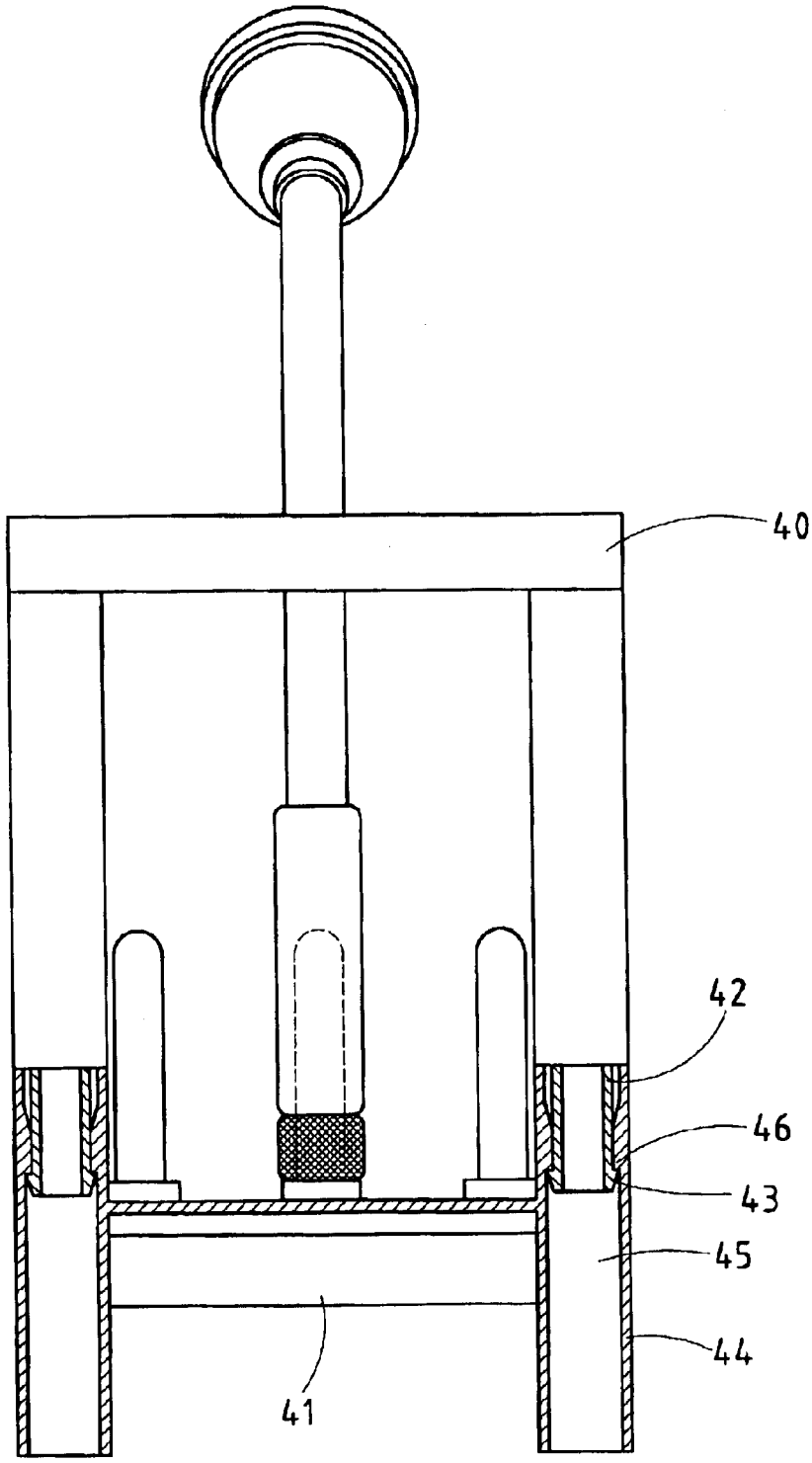
FIG.5 PRIOR ART
FIG. 5 shows a longitudinal sectional view of the prior art rack.

As shown in FIG. 3, the feet 30 of the present invention are provided with a wheel 33 pivoted therewith. The wheeled feet 30 serve to facilitate the moving of the rack from one place to another.

The embodiments of the present invention described above are to be regarded in all respects as being illustrative and nonrestrictive. Accordingly, the present invention may be embodied in other specific forms without deviating from the spirit thereof. The present invention is therefore to be limited only by the scope of the following claims.

I claim:

1. A rack for holding a plurality of spray nozzles, the rack comprising:

a top frame having a plurality of through slots and a plurality of legs; and a bottom frame having a plurality of upright pillars and a plurality of hollow support rods, said plurality of hollow support rods corresponding in number and in location to a number and a location of said plurality of legs of said top frame, said bottom frame being joined to said top frame such that said plurality of legs of said top frame are fitted respectively into said plurality of hollow support rods of said bottom frame, said plurality of through slots of said top frame corresponding in location to a location of said plurality of upright pillars of said bottom frame, said plurality of upright pillars suitable for receiving respectively barrels of the plurality of spray nozzles through the corresponding through slots of said top frame, said plurality of legs of said top frame respectively having a plurality of retaining slots adjacent a bottom end thereof, each of said plurality of hollow support rods having a foot fitted into the bottom end of the legs, each said foot having a plurality of retaining projections, said plurality of retaining projections being retained in the retaining slots at said bottom end of a respective one of said plurality of legs of said top frame, an each said foot having a wheel pivoted therewith.

2. The rack of claim 1, said foot being of a skidproof material.

* * * * *